US010249321B2

(12) United States Patent
King et al.

(10) Patent No.: US 10,249,321 B2
(45) Date of Patent: Apr. 2, 2019

(54) SOUND RATE MODIFICATION

(71) Applicant: Adobe Inc., San Jose, CA (US)

(72) Inventors: Brian John King, Seattle, WA (US); Gautham J. Mysore, San Francisco, CA (US); Paris Smaragdis, Urbana, IL (US)

(73) Assignee: Adobe Inc., San Jose, CA (US)

( * ) Notice: Subject to any disclaimer, the term of this patent is extended or adjusted under 35 U.S.C. 154(b) by 269 days.

(21) Appl. No.: 13/681,643

(22) Filed: Nov. 20, 2012

(65) Prior Publication Data

US 2014/0142947 A1 May 22, 2014

(51) Int. Cl.
*G10L 21/00* (2013.01)
*G10L 21/043* (2013.01)

(52) U.S. Cl.
CPC ..... *G10L 21/043* (2013.01)

(58) Field of Classification Search
CPC ..... G10L 21/00
USPC ..... 704/270, 4, 9, 235, 260
See application file for complete search history.

(56) References Cited

U.S. PATENT DOCUMENTS 4,550,425 A * 10/1985 Andersen ..... G10L 19/00 341/138
4,591,928 A 5/1986 Bloom et al.
5,151,998 A 9/1992 Capps
5,301,109 A * 4/1994 Landauer ..... G06F 17/274 704/2
5,305,420 A * 4/1994 Nakamura ..... G09B 19/04 704/208
5,325,298 A * 6/1994 Gallant ..... G06F 17/274 704/9
5,351,095 A 9/1994 Kerdranvat
5,418,717 A * 5/1995 Su ..... G06F 17/271 704/9
5,490,061 A * 2/1996 Tolin ..... G06F 17/2755 704/2
5,510,981 A * 4/1996 Berger ..... G06F 17/2818 704/2
5,642,522 A * 6/1997 Zaenen ..... G06F 17/274 704/9
5,652,828 A * 7/1997 Silverman ..... 704/260
5,671,283 A 9/1997 Michener et al.
5,710,562 A * 1/1998 Gormish ..... G06T 9/005 341/106

(Continued)

FOREIGN PATENT DOCUMENTS

WO WO-2010086317 8/2010

OTHER PUBLICATIONS

"Non-Final Office Action", U.S. Appl. No. 13/680,952, dated Aug. 4, 2014, 8 pages.

(Continued)

*Primary Examiner* — Michael C Colucci
(74) *Attorney, Agent, or Firm* — Wolfe-SBMC

(57) ABSTRACT

Sound rate modification techniques are described. In one or more implementations, an indication is received of an amount that a rate of output of sound data is to be modified. One or more sound rate rules are applied to the sound data that, along with the received indication, are usable to calculate different rates at which different portions of the sound data are to be modified, respectively. The sound data is then output such that the calculated rates are applied.

20 Claims, 6 Drawing Sheets

(56) References Cited

U.S. PATENT DOCUMENTS 5,717,818 A * 2/1998 Nejime ..... G10L 21/04 381/23.1
5,749,073 A 5/1998 Slaney
5,802,525 A * 9/1998 Rigoutsos ..... G06F 17/30949
5,842,204 A * 11/1998 Andrews ..... G06F 8/33
5,950,194 A * 9/1999 Bennett ..... G06F 17/24 348/E7.083
6,122,375 A 9/2000 Takaragi et al.
6,208,348 B1 3/2001 Kaye
6,266,412 B1 7/2001 Berenzweig et al.
6,304,846 B1 * 10/2001 George ..... G10L 13/033 704/205
6,316,712 B1 11/2001 Laroche
6,333,983 B1 12/2001 Enichen
6,353,824 B1 * 3/2002 Boguraev ..... G06F 17/214 704/9
6,370,247 B1 4/2002 Takaragi et al.
6,442,524 B1 * 8/2002 Ecker ..... G06F 17/2755 704/257
6,480,957 B1 11/2002 Liao et al.
6,687,671 B2 * 2/2004 Gudorf ..... G06F 17/30719 704/235
6,778,667 B1 8/2004 Bakhle et al.
6,792,113 B1 9/2004 Ansell et al.
6,804,355 B1 10/2004 Graunke
7,003,107 B2 2/2006 Ananth
7,103,181 B2 9/2006 Ananth
7,130,467 B1 10/2006 Bronder et al.
7,142,669 B2 11/2006 Dworkin et al.
7,155,440 B1 * 12/2006 Kronmiller ..... G06F 17/5068 707/797
7,200,226 B2 4/2007 Bace
7,213,156 B2 5/2007 Fukuda
7,218,733 B2 5/2007 Li et al.
7,221,756 B2 5/2007 Patel et al.
7,269,664 B2 9/2007 Hutsch et al.
7,269,854 B2 9/2007 Simmons et al.
7,350,070 B2 3/2008 Smathers et al.
7,400,744 B2 7/2008 Nichani et al.
7,412,060 B2 8/2008 Fukuda
7,418,100 B2 8/2008 McGrew et al.
7,533,338 B2 * 5/2009 Duncan ..... G06F 17/211 707/999.104
7,536,016 B2 5/2009 Benaloh
7,594,176 B1 * 9/2009 English ..... G06F 9/453 715/708
7,603,563 B2 10/2009 Ansell et al.
7,627,479 B2 * 12/2009 Travieso ..... G06F 17/289 704/277
7,636,691 B2 12/2009 Maari
7,672,840 B2 * 3/2010 Sasaki ..... G10L 21/04 704/215
7,680,269 B2 3/2010 Nicolai et al.
7,693,278 B2 4/2010 Hiramatsu
7,711,180 B2 5/2010 Ito et al.
7,715,591 B2 5/2010 Owechko et al.
7,757,299 B2 7/2010 Robert et al.
7,827,408 B1 11/2010 Gehringer
7,836,311 B2 11/2010 Kuriya et al.
7,861,312 B2 12/2010 Lee et al.
7,884,854 B2 2/2011 Banner et al.
7,924,323 B2 4/2011 Walker et al.
8,050,906 B1 * 11/2011 Zimmerman ..... G06F 17/2836 704/2
8,051,287 B2 11/2011 Shetty et al.
8,082,592 B2 12/2011 Harris
8,095,795 B2 1/2012 Levy
8,099,519 B2 1/2012 Ueda
8,103,505 B1 * 1/2012 Silverman et al. ..... 704/260
8,130,952 B2 3/2012 Shamoon et al.
8,134,637 B2 3/2012 Rossbach et al.
8,184,182 B2 5/2012 Lee et al.
8,189,769 B2 5/2012 Ramasamy et al.
8,199,216 B2 6/2012 Hwang
8,205,148 B1 6/2012 Sharpe et al.
8,245,033 B1 8/2012 Shetty et al.
8,290,294 B2 10/2012 Kopf et al.
8,291,219 B2 10/2012 Eto
8,300,812 B2 10/2012 Van De Ven
8,315,396 B2 11/2012 Schreiner et al.
8,340,461 B2 12/2012 Sun et al.
8,345,976 B2 1/2013 Wang et al.
8,346,751 B1 1/2013 Jin et al.
8,355,565 B1 1/2013 Yang et al.
8,390,704 B2 3/2013 Wang et al.
8,417,806 B2 4/2013 Chawla et al.
8,428,390 B2 4/2013 Li et al.
8,447,098 B1 5/2013 Cohen et al.
8,520,083 B2 8/2013 Webster et al.
8,543,386 B2 9/2013 Oh et al.
8,548,226 B2 10/2013 Sakano et al.
8,571,305 B2 10/2013 Kao
8,571,308 B2 10/2013 Grafulla-González
8,583,443 B2 * 11/2013 Misawa ..... 704/278
8,586,847 B2 11/2013 Ellis et al.
8,588,551 B2 11/2013 Joshi et al.
8,615,108 B1 12/2013 Stoppa et al.
8,619,082 B1 12/2013 Ciurea et al.
8,675,962 B2 3/2014 Mori et al.
8,694,319 B2 * 4/2014 Bodin et al. ..... 704/258
8,731,913 B2 5/2014 Zopf et al.
8,738,633 B1 5/2014 Sharifi et al.
8,751,022 B2 6/2014 Eppolito
8,805,560 B1 8/2014 Tzanetakis et al.
8,855,334 B1 10/2014 Lavine et al.
8,879,731 B2 11/2014 Schultz
8,886,543 B1 11/2014 Sharifi et al.
8,903,088 B2 12/2014 Schultz
8,914,290 B2 * 12/2014 Hendrickson et al. ..... 704/260
8,953,811 B1 2/2015 Sharifi et al.
9,064,318 B2 6/2015 Price et al.
9,076,205 B2 7/2015 Cho et al.
9,135,710 B2 9/2015 Cohen et al.
9,201,580 B2 12/2015 King et al.
9,208,547 B2 12/2015 Cohen et al.
9,214,026 B2 12/2015 Price et al.
9,355,649 B2 5/2016 King et al.
9,451,304 B2 9/2016 King et al.
2002/0081019 A1 6/2002 Katayama et al.
2002/0086269 A1 * 7/2002 Shpiro ..... G09B 7/02 434/156
2002/0099547 A1 * 7/2002 Chu ..... G10L 13/07 704/260
2002/0154779 A1 10/2002 Asano et al.
2003/0028380 A1 * 2/2003 Freeland ..... G10L 13/00 704/260
2004/0030656 A1 2/2004 Kambayashi et al.
2004/0122656 A1 * 6/2004 Abir ..... G06F 17/2872 704/4
2004/0122662 A1 6/2004 Crockett
2004/0218834 A1 11/2004 Bishop et al.
2004/0254660 A1 12/2004 Seefeldt
2005/0015343 A1 1/2005 Nagai et al.
2005/0021323 A1 * 1/2005 Li ..... G06F 17/2735 704/5
2005/0069207 A1 3/2005 Zakrzewski et al.
2005/0198448 A1 9/2005 Fevrier et al.
2005/0201591 A1 9/2005 Kiselewich
2005/0232463 A1 10/2005 Hirvonen et al.
2006/0045211 A1 3/2006 Oh et al.
2006/0078194 A1 4/2006 Fradkin et al.
2006/0122839 A1 6/2006 Li-Chun Wang et al.
2006/0147087 A1 7/2006 Goncalves et al.
2006/0165240 A1 7/2006 Bloom et al.
2006/0173846 A1 8/2006 Omae et al.
2007/0041663 A1 2/2007 Cho et al.
2007/0061145 A1 * 3/2007 Edgington ..... G10L 13/033 704/262
2007/0070226 A1 3/2007 Matusik et al.
2007/0087756 A1 4/2007 Hoffberg
2007/0098250 A1 5/2007 Molgaard et al.
2007/0242900 A1 10/2007 Chen et al.
2007/0291958 A1 12/2007 Jehan

(56) References Cited

U.S. PATENT DOCUMENTS

| | | | |
|---|---|---|---|
| 2008/0120230 | A1 | 5/2008 | Lebegue et al. |
| 2008/0278584 | A1 | 11/2008 | Shih et al. |
| 2009/0055139 | A1 | 2/2009 | Agarwal et al. |
| 2009/0110076 | A1 | 4/2009 | Chen |
| 2009/0125726 | A1 | 5/2009 | Iyer et al. |
| 2009/0195643 | A1 | 8/2009 | Neuman |
| 2009/0259684 | A1 | 10/2009 | Knight et al. |
| 2009/0276628 | A1 | 11/2009 | Cho et al. |
| 2009/0279697 | A1 | 11/2009 | Schneider |
| 2009/0290710 | A1 | 11/2009 | Tkachenko et al. |
| 2009/0290786 | A1 | 11/2009 | Stevens et al. |
| 2009/0297059 | A1 | 12/2009 | Lee et al. |
| 2009/0306972 | A1 | 12/2009 | Opitz et al. |
| 2009/0307489 | A1 | 12/2009 | Endoh |
| 2009/0315670 | A1 | 12/2009 | Naressi et al. |
| 2010/0023864 | A1 | 1/2010 | Lengeling et al. |
| 2010/0105454 | A1 | 4/2010 | Weber |
| 2010/0153747 | A1 | 6/2010 | Asnaashari et al. |
| 2010/0172567 | A1 | 7/2010 | Prokoski |
| 2010/0208779 | A1 | 8/2010 | Park et al. |
| 2010/0246816 | A1 | 9/2010 | Thomas et al. |
| 2010/0257368 | A1 | 10/2010 | Yuen |
| 2010/0272311 | A1 | 10/2010 | Nir et al. |
| 2010/0279766 | A1 | 11/2010 | Pliska et al. |
| 2010/0295783 | A1 | 11/2010 | El Dokor et al. |
| 2010/0322042 | A1 | 12/2010 | Serletic et al. |
| 2011/0026596 | A1 | 2/2011 | Hong |
| 2011/0043603 | A1 | 2/2011 | Schechner et al. |
| 2011/0043864 | A1 | 2/2011 | Tian et al. |
| 2011/0112670 | A1 | 5/2011 | Disch et al. |
| 2011/0131219 | A1 | 6/2011 | Martin-Cocher et al. |
| 2011/0161669 | A1 | 6/2011 | Eto |
| 2011/0173208 | A1 | 7/2011 | Vogel |
| 2011/0230987 | A1 | 9/2011 | Anguera Miró et al. |
| 2011/0261257 | A1 | 10/2011 | Terry et al. |
| 2012/0027295 | A1 | 2/2012 | Shao |
| 2012/0042167 | A1 | 2/2012 | Marking et al. |
| 2012/0046954 | A1 | 2/2012 | Lindahl et al. |
| 2012/0056982 | A1 | 3/2012 | Katz et al. |
| 2012/0071239 | A1 | 3/2012 | Graepel et al. |
| 2012/0105728 | A1 | 5/2012 | Liu |
| 2012/0130822 | A1 | 5/2012 | Patwa et al. |
| 2012/0151320 | A1 | 6/2012 | McClements, IV |
| 2012/0173865 | A1 | 7/2012 | Swaminathan |
| 2012/0173880 | A1 | 7/2012 | Swaminathan |
| 2012/0216300 | A1 | 8/2012 | Vivolo et al. |
| 2012/0219229 | A1 | 8/2012 | Springer et al. |
| 2012/0321172 | A1 | 12/2012 | Jachalsky et al. |
| 2013/0064443 | A1 | 3/2013 | Schlosser et al. |
| 2013/0113881 | A1 | 5/2013 | Barnum |
| 2013/0127824 | A1 | 5/2013 | Cohen |
| 2013/0132733 | A1 | 5/2013 | Agrawal et al. |
| 2013/0142330 | A1 | 6/2013 | Schultz |
| 2013/0142331 | A1 | 6/2013 | Schultz |
| 2013/0173273 | A1 | 7/2013 | Kuntz et al. |
| 2013/0191491 | A1 | 7/2013 | Kotha et al. |
| 2013/0230247 | A1 | 9/2013 | Schlosser et al. |
| 2013/0235201 | A1 | 9/2013 | Kiyohara et al. |
| 2013/0243313 | A1 | 9/2013 | Civit et al. |
| 2013/0243314 | A1 | 9/2013 | Civit et al. |
| 2013/0290818 | A1 | 10/2013 | Arrasvuori et al. |
| 2013/0343606 | A1 | 12/2013 | Dal Mutto et al. |
| 2014/0023291 | A1 | 1/2014 | Lin |
| 2014/0119643 | A1 | 5/2014 | Price |
| 2014/0133675 | A1 | 5/2014 | King et al. |
| 2014/0135962 | A1 | 5/2014 | King et al. |
| 2014/0136976 | A1 | 5/2014 | King et al. |
| 2014/0140626 | A1 | 5/2014 | Cho |
| 2014/0148933 | A1 | 5/2014 | King |
| 2014/0152776 | A1 | 6/2014 | Cohen |
| 2014/0153816 | A1 | 6/2014 | Cohen |
| 2014/0168215 | A1 | 6/2014 | Cohen |
| 2014/0169660 | A1 | 6/2014 | Cohen |
| 2014/0177903 | A1 | 6/2014 | Price |
| 2014/0201630 | A1 | 7/2014 | Bryan |
| 2014/0254881 | A1 | 9/2014 | Jin |
| 2014/0254882 | A1 | 9/2014 | Jin |
| 2014/0254933 | A1 | 9/2014 | Jin |
| 2014/0254943 | A1 | 9/2014 | Jin |
| 2014/0310006 | A1 | 10/2014 | Anguera Miro et al. |

OTHER PUBLICATIONS

"Notice of Allowance", U.S. Appl. No. 13/309,982, dated Jul. 30, 2014, 6 pages.

"Notice of Allowance", U.S. Appl. No. 13/310,032, dated Aug. 26, 2014, 6 pages.

"Restriction Requirement", U.S. Appl. No. 13/660,159, dated Jun. 12, 2014, 6 pages.

"Final Office Action", U.S. Appl. No. 13/690,755, dated Sep. 10, 2014, 7 pages.

"Non-Final Office Action", U.S. Appl. No. 13/660,159, dated Oct. 1, 2014, 7 pages.

"Restriction Requirement", U.S. Appl. No. 13/722,825, dated Oct. 9, 2014, 7 pages.

"Supplemental Notice of Allowance", U.S. Appl. No. 13/310,032, dated Nov. 3, 2014, 4 pages.

Zhu, et al., "Fusion of Time-of-Flight Depth and Stereo for High Accuracy Depth Maps", IEEE Conference on Computer Vision and Pattern Recognition, Jun. 23, 2008, 8 pages.

"Non-Final Office Action", U.S. Appl. No. 13/310,032, dated Mar. 7, 2014, 21 pages.

"Non-Final Office Action", U.S. Appl. No. 13/309,982, dated Mar. 24, 2014, 35 pages.

"Non-Final Office Action", U.S. Appl. No. 13/690,755, dated Mar. 28, 2014, 7 pages.

Kubo, Shiro et al., "Characterization of the Tikhonov Regularization for Numerical Analysis of Inverse Boundary Value Problems by Using the Singular Value Decomposition", *Inverse Problems in Engineering Mechanics*, 1998, (1998), pp. 337-344.

"Non-Final Office Action", U.S. Appl. No. 13/309,982, (dated Jan. 17, 2013), 32 pages.

"Non-Final Office Action", U.S. Appl. No. 13/310,032, (dated Jan. 3, 2013),18 pages.

"Time Domain Pitch Scaling using Synchronous Overlap and Add", retrieved from <http://homepages.inspire.net.nz/~jamckinnon/report/sola.htm> on Nov. 12, 2012, 3 pages.

"Waveform Similarity Based Overlap-Add (WSOLA)", retrieved from <http://www.pjsip.org/pjmedia/docs/html/droup__PJMED__WSOLA.htm> on Nov. 12, 2012, 4 pages.

De Gotzen, Amalia et al., "Traditional (?) Implementations of a Phase-Vocoder: The Tricks of the Trade", *Proceedings of the COST G-6 Conference on Digital Audio Effects* (*DAFX-00*), Verona, Italy, Dec. 7-9, 2000, retrieved from <http://128.112.136.35/courses/archive/spring09/cos325/Bernardini.pdf> on Nov. 12, 2012,(Dec. 7, 2000), 7 pages.

Dolson, Mark "The Phase Vocoder: A Tutorial", retrieved from <http://www.panix.com/~jens/pvoc-dolson.par> on Nov. 12, 2012, 11 pages.

Gutierrez-Osuna, Ricardo "L19: Prosodic Modificatin of Speech", Lecture based on [Taylor, 2009, ch. 14; Holmes, 2001, ch. 5; *Moulines and Charpentier*, 1990], retrieved from <http://research.cs.tamu.edu/prism/lectures/sp/l19.pdf> on Nov. 12, 2012, 35 pages.

He, et al., "Corner detector based on global and local curvature properties", Retrieved from <http://hub.hku.hk/bitstream/10722/57246/1/142282.pdf> on Dec. 21, 2012, (May 2008), 13 pages.

Hirsch, et al., "Fast Removal of Non-uniform Camera Shake", Retrieved from <http://webdav.is.mpg.de/pixel/fast_removal_of_camera_shake/files/Hirsch_ICCV2011_Fast%20removal%20of%20non-uniform%20camera%20shake.pdf> on Dec. 21, 2012, 8 pages.

Jia, Jiaya "Single Image Motion Deblurring Using Transparency", Retrieved from <http://www.cse.cuhk.edu.hk/~leojia/all_final_papers/motion_deblur_cvpr07.pdf> on Dec. 21, 2012, 8 pages.

Klingbeil, Michael "SPEAR: Sinusoidal Partial Editing Analysis and Resynthesis", retrieved from <http://www.klingbeil.com/spear/> on Nov. 12, 2012, 3 pages.

(56) References Cited

OTHER PUBLICATIONS

Levin, et al., "Image and Depth from a Conventional Camera with a Coded Aperture", *ACM Transactions on Graphics, SIGGRAPH 2007 Conference Proceedings*, San Diego, CA Retrieved from <http://groups.csail.mit.edu/graphics/CodedAperture/CodedAperture-LevinEtAl-SIGGRAPH07.pdf> on Dec. 21, 2012,(2007), 9 pages.
McAulay, R. J., et al., "Speech Processing Based on a Sinusoidal Model", *The Lincoln Laboratory Journal*, vol. 1, No. 2, 1998, retrieved from <http://www.ll.mit.edu/publications/journal/pdf/vol01_no2/1.2.3.speechprocessing.pdf> on Nov. 12, 2012,(1988), pp. 153-168.
Moinet, Alexis et al., "PVSOLA: A Phase Vocoder with Synchronized Overlap-Add", *Proc. of the 14th Int. Conference on Digital Audio Effects* (*DAFx-11*), Paris, France, Sep. 19-23, 2011, retrieved from <http://tcts.fpms.ac.be/publications/papers/2011/dafx2011_pvsola_amtd.pdf> on Nov. 12, 2012,(Sep. 19, 2011), 7 pages.
Patton, Joshua "ELEC 484 Project—Pitch Synchronous Overlap-Add", retrieved from <http://www.joshpatton.org/yeshua/Elec484/Elec484_files/ELEC%20484%20-%20PSOLA%20Final%20Project%20Report.pdf> on Nov. 12, 2012, 11 pages.
Rodet, Xavier "Musical Sound Signal Analysis/Synthesis: Sinusoidal+Residual and Elementary Waveform Models", TFTS'97 (IEEE Time-Frequency and Time-Scale Workshop 97), Coventry, Grande Bretagne, août, 1997, retrieved from <http://articles.ircam.fr/textes/Rodet97e/index.html> on Nov. 12, 2012,(1997), 16 pages.
Roelands, Marc et al., "Waveform Similarity Based Overlap-Add (WSOLA) for Time-Scale Modification of Speech: Structures and Evaluation", retrieved from <http://citeseerx.ist.psu.edu/viewdoc/summary?doi=10.1.1.58.1356> on Nov. 12, 2012, 4 pages.
Serra, Xavier "A System for Sound Analysis/Transformation/Synthesis Based on a Deterministic Plus Stochastic Decomposition", retrieved from <https://ccrma.stanford.edu/files/papers/stanm58.pdf> on Nov. 12, 2012, (Oct. 1989), 166 pages.
Serra, Xavier "Approaches to Sinusoidal Plus Residual Modeling", retrieved from <http://www.dtic.upf.edu/~xserra/cursos/CCRMA-workshop/lectures/7-SMS-related-research.pdf> on Nov. 12, 2012, 21 pages.
Serra, Xavier "Musical Sound Modeling with Sinusoids Plus Noise", published in C. Roads, S. Pope, A. Picialli, G. De Poli, editors. 1997. "*Musical Signal Processing*". Swets & Zeitlinger Publishers, retrieved from <http://web.media.mit.edu/~tristan/Classes/MAS.945/Papers/Technical/Serra_SMS_97.pdf> on Nov. 12, 2012,(1997), 25 pages.
Smith III, Julius O., "MUS421/EE367B Applications Lecture 9C: Time Scale Modification (TSM) and Frequency Scaling/Shifting", retrieved from <https://ccrma.stanford.edu/~jos/TSM/TSM.pdf> on Nov. 12, 2012, (Mar. 8, 2012),15 pages.
Upperman, Gina "Changing Pitch with PSOLA for Voice Conversion", retrieved from <http://cnx.org/content/m12474/latest/?collection=col10379/1.1> on Nov. 12, 2012, 1 page.
Verhelst, Werner "Overlap-Add Methods for Time-Scaling of Speech", retrieved from <http://citeseerx.ist.psu.edu/viewdoc/summary?doi=10.1.1.128.7991> on Nov. 12, 2012, 25 pages.
Verhelst, Werner et al., "An Overlap-Add Technique Based on Waveform Similarity (WSOLA) for High Quality Time-Scale Modification of Speech", retrieved from <http://citeseerx.ist.psu.edu/viewdoc/download?doi=10.1.1.202.5460&rep=rep1&type=pdf> on Nov. 12, 2012, 4 pages.
Yuan, et al., "Image Deblurring with Blurred/Noisy Image Pairs", *Proceedings of ACM SIGGRAPH*, vol. 26, Issue 3, (Jul. 2007),10 pages.
"Final Office Action", U.S. Appl. No. 13/309,982, (dated Nov. 1, 2013), 34 pages.
"Final Office Action", U.S. Appl. No. 13/310,032, (dated Oct. 31, 2013), 21 pages.
Felzenszwalb, Pedro F., et al., "Efficient Belief Propagation for Early Vision", *International Journal of Computer Vision*, 70(1), (2006), pp. 41-54.
Gastal, Eduardo S., et al., "Shared Sampling for Real-Time Alpha Matting", *Eurographics 2010*, vol. 29, No. 2, (2010),10 pages.
He, Kaiming et al., "A Global Sampling Method for Alpha Matting", *CVPR 2011*, (2011), pp. 2049-2056.
Levin, Anat et al., "A Closed Form Solution to Natural Image Matting", *CVPR*, 2006, (2006), 8 pages.
Park, Youngja et al., "Extracting Salient Keywords from Instructional Videos Using Joint Text, Audio and Visual Cues", *Proceedings of the Human Language Technology Conference of the North American Chapter of the ACL*, Association for Computational Linguistics, 2006,(Jun. 2006), pp. 109-112.
Radhakrishnan, Regunathan et al., "A Content-Adaptive Analysis and Representation Framework for Audio Event Discovery from "Unscripted" Multimedia", *Hindawi Publishing Corporation, EURASIP Journal on Applied Signal Processing*, vol. 2006, Article ID 89013, (2006), 24 pages.
Smaragdis, Paris "A Probabilistic Latent Variable Model for Acoustic Modeling", *NIPS*, (2006), 6 pages.
Smaragdis, Paris "Supervised and Semi-Supervised Separation of Sounds from Single-Channel Mixtures", *ICA'07 Proceedings of the 7th international conference on Independent component analysis and signal separation*, (2007), 8 pages.
Smith, Alvy R., et al., "Blue Screen Matting", *SIGGRAPH 96 Conference Proceedings*, (Aug. 1996), 10 pages.
Yang, Qingxiong et al., "A Constant-Space Belief Propagation Algorithm for Stereo Matching", *CVPR*, (2010), 8 pages.
"Adobe Audion", User Guide, 2003, 390 pages.
"MPEG Surround Specification", International Organization for Standardization, Coding of Moving Pictures and Audio; ISO/IEF JTC 1/SC 29/WG 11; Bangkok, Thailand, Jan. 19, 2006, 186 pages.
"Non-Final Office Action", U.S. Appl. No. 13/675,711, dated Mar. 11, 2015, 14 pages.
"Non-Final Office Action", U.S. Appl. No. 13/675,807, dated Dec. 17, 2014, 18 pages.
"Non-Final Office Action", U.S. Appl. No. 13/675,844, dated Dec. 19, 2014, 10 pages.
"Non-Final Office Action", U.S. Appl. No. 13/688,421, dated Feb. 4, 2015, 18 pages.
"Non-Final Office Action", U.S. Appl. No. 13/690,755, dated Mar. 2, 2015, 8 pages.
"Non-Final Office Action", U.S. Appl. No. 13/720,258, dated Mar. 3, 2015, 14 pages.
"Non-Final Office Action", U.S. Appl. No. 13/794,125, dated Oct. 24, 2014, 19 pages.
"Non-Final Office Action", U.S. Appl. No. 13/794,219, dated Feb. 12, 2015, 28 pages.
"Non-Final Office Action", U.S. Appl. No. 13/794,408, dated Sep. 10, 2014, 14 pages.
"Notice of Allowance", U.S. Appl. No. 13/660,159, dated Mar. 10, 2015, 6 pages.
"Notice of Allowance", U.S. Appl. No. 13/680,952, dated Mar. 17, 2015, 6 pages.
"Notice of Allowance", U.S. Appl. No. 13/794,125, dated Jan. 30, 2015, 7 pages.
"Notice of Allowance", U.S. Appl. No. 13/794,408, dated Feb. 4, 2015, 7 pages.
"Restriction Requirement", U.S. Appl. No. 13/690,724, dated Feb. 26, 2015, 6 Pages.
"Sound Event Recognition With Probabilistic Distance SVMs", IEEE TASLP 19(6), 2011, 2011.
Barnes, et al., "PatchMatch: A Randomized Correspondence Algorithm for Structural Image Editing", ACM SIGGRAPH 2009 Papers (New Orleans, Louisiana, Aug. 3-7, 2009), Aug. 3, 2009, 11 pages.
Barnes, et al., "The Generalized PatchMatch Correspondence Algorithm", European Conference on Computer Vision, Sep. 2010, Retrieved from <http://gfx.cs.princeton.edu/pubs/Barnes_2010_TGP/generalized_pm.pdf> on Sep. 9, 2010,Sep. 2010, 14 pages.
Brox, et al., "Large Displacement Optical Flow: Descriptor Matching in Variational Motion Estimation", IEEE Transactions on Pattern Analysis and Machine Intelligence, 2010, 2011, 14 pages.
Dong, et al., "Adaptive Object Detection and Visibility Improvement in Foggy Image", Journal of Multimedia, vol. 6, No. 1 (2011), Feb. 14, 2011, 8 pages.
Fattal, "Single Image Dehazing", presented at the ACM SIGGRAPH, Los Angeles, California, 2008., 2008, 9 pages.

(56) References Cited

OTHER PUBLICATIONS

He, et al., "Computing Nearest-Neighbor Fields via Propagation-Assisted KD-Trees", CVPR 2012, 2012, 8 pages.
He, et al., "Single Image Haze Removal Using Dark Channel Prior", In Computer Vision and Pattern Recognition, IEEE Conference on, 2009, 2009, 8 pages.
He, et al., "Statistics of Patch Offsets for Image Completion", ECCV 2012, 2012, 14 pages.
Ioffe, "Improved Consistent Sampling, Weighted Minhash and L1 Sketching", ICDM '10 Proceedings of the 2010 IEEE International Conference on Data Mining, Dec. 2010, 10 pages.
Jehan, "Creating Music by Listening", In PhD Thesis of Massachusetts Institute of Technology, Retrieved from <http://web.media.mit.edu/~tristan/Papers/PhD_Tristan.pdf>,Sep. 2005, 137 pages.
Korman, et al., "Coherency Sensitive Hashing", ICCV 2011, 2011, 8 pages.
Li, et al., "Instructional Video Content Analysis Using Audio Information", IEEE TASLP 14(6), 2006, 2006.
Olonetsky, et al., "TreeCANN—k-d tree Coherence Approximate Nearest Neighbor algorithm", European Conference on Computer Vision, 2012, 2012, 14 pages.
Wu, "Fish Detection in Underwater Video of Benthic Habitats in Virgin Islands", University of Miami, May 29, 2012, 72 pages.
Xu, et al., "Motion Detail Preserving Optical Flow Estimation", IEEE Transactions on Pattern Analysis and Machine Intelligence, 34(9), 2012, 2012, 8 pages.
Zhang, et al., "Video Dehazing with Spatial and Temporal Coherence", The Visual Computer: International Journal of Computer Graphics—CGI'2011 Conference, vol. 27, Issue 6-8, Apr. 20, 2011, 9 pages.
"Adobe Audition 3.0 User Guide", 2007, 194 pages.
"Corrected Notice of Allowance", U.S. Appl. No. 13/660,159, dated Apr. 28, 2015, 2 pages.
"Corrected Notice of Allowance", U.S. Appl. No. 13/660,159, dated May 29, 2015, 2 pages.
"Final Office Action", U.S. Appl. No. 13/675,711, dated Jun. 23, 2015, 14 pages.
"Final Office Action", U.S. Appl. No. 13/675,807, dated May 22, 2015, 24 pages.
"Non-Final Office Action", U.S. Appl. No. 13/690,724, dated Jun. 18, 2015, 7 pages.
"Non-Final Office Action", U.S. Appl. No. 13/722,825, dated Mar. 25, 2015, 17 pages.
"Notice of Allowance", U.S. Appl. No. 13/690,755, dated Jun. 5, 2015, 6 pages.
"Supplemental Notice of Allowance", U.S. Appl. No. 13/680,952, dated Jun. 11, 2015, 3 pages.
Su,"Over-Segmentation Based Background Modeling and Foreground Detection with Shadow Removal by Using Hierarchical MRFs", Proceedings of the 10th Asian conference on Computer vision—vol. Part III, Nov. 2010, 12 pages.
Yang,"Stereo Matching with Color-Weighted Correlation, Hierarchical Belief Propagation, and Occlusion Handling", IEEE Transactions on Pattern Analysis and Machine Intelligence , vol. 31 Issue 3, Mar. 2009, 13 pages.
"Corrected Notice of Allowance", U.S. Appl. No. 13/720,258, dated Nov. 13, 2015, 2 pages.
"Corrected Notice of Allowance", U.S. Appl. No. 13/722,825, dated Sep. 21, 2015, 4 pages.
"Corrected Notice of Allowance", U.S. Appl. No. 13/722,825, dated Nov. 16, 2015, 4 pages.
"Final Office Action", U.S. Appl. No. 13/675,844, dated Aug. 14, 2015, 17 pages.
"Final Office Action", U.S. Appl. No. 13/688,421, dated Jul. 29, 2015, 22 pages.
"Final Office Action", U.S. Appl. No. 13/690,724, dated Dec. 10, 2015, 11 pages.
"First Action Interview Office Action", U.S. Appl. No. 13/720,316, dated Oct. 22, 2015, 4 pages.
"Non-Final Office Action", U.S. Appl. No. 13/688,421, dated Jan. 7, 2016, 20 pages.
"Notice of Allowance", U.S. Appl. No. 13/675,807, dated Aug. 27, 2015, 6 pages.
"Notice of Allowance", U.S. Appl. No. 13/720,258, dated Jul. 24, 2015, 8 pages.
"Notice of Allowance", U.S. Appl. No. 13/720,258, dated Sep. 18, 2015, 2 pages.
"Notice of Allowance", U.S. Appl. No. 13/722,825, dated Aug. 28, 2015, 10 pages.
"Pre-Interview Communication", U.S. Appl. No. 13/720,316, dated Aug. 5, 2015, 3 pages.
"Supplemental Notice of Allowance", U.S. Appl. No. 13/690,755, dated Aug. 18, 2015, 4 pages.
Dueck,"Non-metric Affinity Propagation for Unsupervised Image Categorization", IEEE 11th International Conference on Computer Vision, 2007, Oct. 14, 2007, 8 pages.
Xiao,"Joint Affinity Propagation for Multiple View Segmentation", IEEE 11th International Conference on Computer Vision, 2007, Oct. 14, 2007, 7 pages.
"Notice of Allowance", U.S. Appl. No. 13/675,711, dated Jan. 20, 2016, 11 pages.
"Non-Final Office Action", U.S. Appl. No. 13/690,724, dated Apr. 5, 2016, 11 pages.
"Non-Final Office Action", U.S. Appl. No. 13/720,316, dated Apr. 8, 2016, 14 pages.
"Non-Final Office Action", U.S. Appl. No. 13/675,844, dated Feb. 12, 2016, 17 pages.
"Sonar X1", Sonar, 2010, pp. 573,595-599.
"Notice of Allowance", U.S. Appl. No. 13/688,421, dated Jun. 6, 2016, 10 pages.
"Final Office Action", U.S. Appl. No. 13/675,844, dated Jul. 19, 2016, 16 pages.
"Corrected Notice of Allowance", U.S. Appl. No. 13/688,421, dated Aug. 22, 2016, 2 pages.
"Non-Final Office Action", U.S. Appl. No. 13/690,724, dated Oct. 24, 2016, 13 pages.
"Non-Final Office Action", U.S. Appl. No. 13/720,316, dated Oct. 4, 2016, 15 pages.
"Examiner's Answer to Appeal Brief", U.S. Appl. No. 13/675,844, dated Apr. 13, 2017, 15 pages.
"Final Office Action", U.S. Appl. No. 13/690,724, dated May 17, 2017, 15 pages.
"Non-Final Office Action", U.S. Appl. No. 13/720,316, dated May 9, 2017, 16 pages.
"Non-Final Office Action", U.S. Appl. No. 13/690,724, dated Dec. 1, 2017, 15 pages.
"Final Office Action", U.S. Appl. No. 13/720,316, dated Nov. 17, 2017, 17 pages.
"Non-Final Office Action", U.S. Appl. No. 13/720,316, dated Apr. 19, 2018, 10 pages.
"Non-Final Office Action", U.S. Appl. No. 13/690,724, dated Aug. 9, 2018, 8 pages.
"Notice of Allowance", U.S. Appl. No. 13/720,316, dated Aug. 16, 2018, 8 pages.
"PTAB Decision", U.S. Appl. No. 13/675,844, Nov. 29, 2018, 7 pages.

* cited by examiner

SOUND RATE MODIFICATION

BACKGROUND

Sound rate modification may be utilized for a variety of purposes. A user, for instance, may desire to slow down a rate at which speech is output, such as to transcribe a meeting, listen to a lecture, learn a language, and so on. The user may also desire to speed up a rate at which speech or other sounds are output, such as to lessen an amount of time to listen to a podcast. Other examples are also contemplated.

However, conventional techniques that were utilized to modify the sound rate could sound unnatural, especially when utilized to process speech. Conventional techniques, for instance, generally changed a sampling rate which has an effect similar to adjusting RPM for a vinyl record in that both time and pitch are modified. Accordingly, speech could sound deeper and drawn out when slowed down with the reverse also true when the speech was sped up. Therefore, users often chose to forgo these conventional techniques due to the unnatural sounding nature of the conventional rate modifications.

SUMMARY

Sound rate modification techniques are described. In one or more implementations, an indication is received of an amount that a rate of output of sound data is to be modified. One or more sound rate rules are applied to the sound data that, along with the received indication, are used to calculate different rates at which different portions of the sound data are to be modified, respectively. The sound data is then output such that the calculated rates are applied.

This Summary introduces a selection of concepts in a simplified form that are further described below in the Detailed Description. As such, this Summary is not intended to identify essential features of the claimed subject matter, nor is it intended to be used as an aid in determining the scope of the claimed subject matter.

BRIEF DESCRIPTION OF THE DRAWINGS

The detailed description is described with reference to the accompanying figures. In the figures, the left-most digit(s) of a reference number identifies the figure in which the reference number first appears. The use of the same reference numbers in different instances in the description and the figures may indicate similar or identical items. Entities represented in the figures may be indicative of one or more entities and thus reference may be made interchangeably to single or plural forms of the entities in the discussion.

DETAILED DESCRIPTION

Overview

Conventional techniques that were utilized to modify a rate at which sound was output could sound unnatural. For example, a rate at which speech is output may be slowed down to increase comprehension on the part of a user. However, this slowdown could also result in degradation of the speech due to changes in pitch and timing, which could cause a user to forgo use of these conventional techniques.

Sound rate modification techniques are described. In one or more implementations, sound rate rules are generated to reflect a natural sound model. These sound rate rules may then be employed to modify a rate at which sound data is output in a manner that is more natural sounding to a user.

For example, a recording of a user reading a chapter in a book for ten minutes may sound quite different than a recording of the user reading the same chapter for fifteen minutes. When comparing the recordings, for instance, differences may be noted in that the longer recording is not simply the same as the shorter recording slowed down by fifty percent. Rather, the rates at different portions of recordings may change, such as an increase in pauses, use of similar rates for some vowel sounds over other sounds, and so on.

Accordingly, the sound rate modification techniques described herein may leverage these differences to modify a rate at which sound data is to be output in a natural manner, unlike conventional techniques. For example, sound rate rules may be applied to calculate different rates for different portions of the sound data, such as for pauses versus active speech. In this way, naturalness of the sound data may be preserved even if a rate modification is desired. Further discussion of these and other examples may be found in relation to the following sections.

In the following discussion, an example environment is first described that may employ the techniques described herein. Example procedures are then described which may be performed in the example environment as well as other environments. Consequently, performance of the example procedures is not limited to the example environment and the example environment is not limited to performance of the example procedures.

Example Environment

Figure 1:
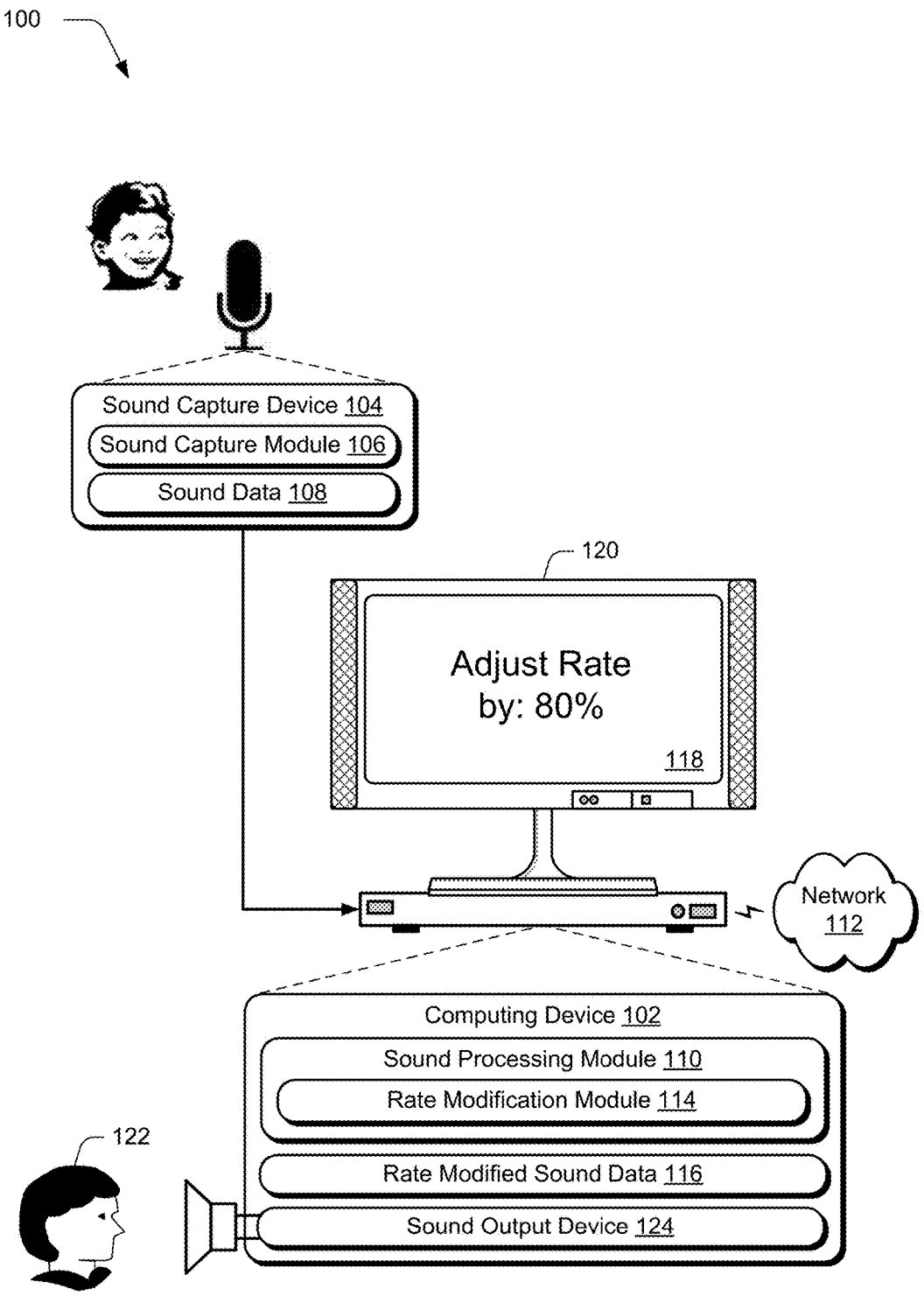
FIG. 1 is an illustration of an environment in an example implementation that is operable to employ sound rate modification techniques as described herein.

FIG. 1 is an illustration of an environment 100 in an example implementation that is operable to employ sound rate modification techniques described herein. The illustrated environment 100 includes a computing device 102 and sound capture device 104, which may be configured in a variety of ways.

The computing device 102, for instance, may be configured as a desktop computer, a laptop computer, a mobile device (e.g., assuming a handheld configuration such as a tablet or mobile phone), and so forth. Thus, the computing device 102 may range from full resource devices with substantial memory and processor resources (e.g., personal computers, game consoles) to a low-resource device with limited memory and/or processing resources (e.g., mobile devices). Additionally, although a single computing device 102 is shown, the computing device 102 may be representative of a plurality of different devices, such as multiple servers utilized by a business to perform operations "over the cloud" as further described in relation to FIG. 6.

The sound capture device 104 may also be configured in a variety of ways. Illustrated examples of one such configuration involves a standalone device but other configurations are also contemplated, such as part of a mobile phone, video camera, tablet computer, part of a desktop microphone, array microphone, and so on. Additionally, although the sound capture device 104 is illustrated separately from the computing device 102, the sound capture device 104 may be configured as part of the computing device 102, further divided, and so on.

The sound capture device 104 is illustrated as including a respective sound capture module 106 that is representative of functionality to generate sound data 108. This sound data 108 may also be generated in a variety of other ways, such as automatically through part of a video game.

Regardless of where the sound data 108 originated, this data may then be obtained by the computing device 102 for processing by a sound processing module 110. Although illustrated as part of the computing device 102, functionality represented by the sound processing module 110 may be further divided, such as to be performed "over the cloud" via a network 112 connection, further discussion of which may be found in relation to FIG. 6.

An example of functionality of the sound processing module 110 is represented as a rate modification module 114. The rate modification module 114 is representative of functionality to modify a rate at which the sound data 108 is output, which is illustrated as an ability to generate rate modified sound data 116.

Modification of a rate at which the sound data is output may be used to support a variety of different functionalities. Examples of these functionalities include allowing an audio editor to adjust the length of a speech clip for use in a radio show or podcast, speeding up playback of an audio book, podcast, recorded radio show, or other speech recording to simply listen faster, which may be similar to speed reading.

Additional examples includes use as an aid in teaching a user to read, allowing a user to slow down playback to increase comprehension for someone with hearing problems or a mental handicap, slowing down playback to increase understanding of a complex subject, and modifying playback rate to aid in VOIP call intelligibility. Further examples include assisting a user that spoke, such as playing back someone's own speech at a different rate to aid in biofeedback for speaking faster, slower, or more naturally, assisting a user in learning new languages or helping a user with a speech impediment, and so forth.

The rate modification module 114, for instance, may cause output of a user interface 118 on a display device 120. A user may interact with the user interface 118 (e.g., via a gesture, keyboard, voice command, cursor control device, and so on) to specify an amount of a rate that the sound data 108 is to be modified to generate the rate modified sound data 116. This may be performed in a variety of ways, such as by specifying an amount of time the rate modified sound data 116 is to be output (e.g., 20 minutes), an amount by which the output of the sound is to be modified (e.g., 80% as illustrated), and so on. The rate modification module 114 may then employ this input along with rate modification rules which reflect a natural sound model to increase or decrease the rate accordingly in a manner that has an increased likelihood of sounding natural to the user 122 when output by a sound output device 124, e.g., a speaker. An example of techniques that may be utilized by the rate modification module 114 to perform this rate modification are described as follows and shown in a corresponding figure.

Figure 2:
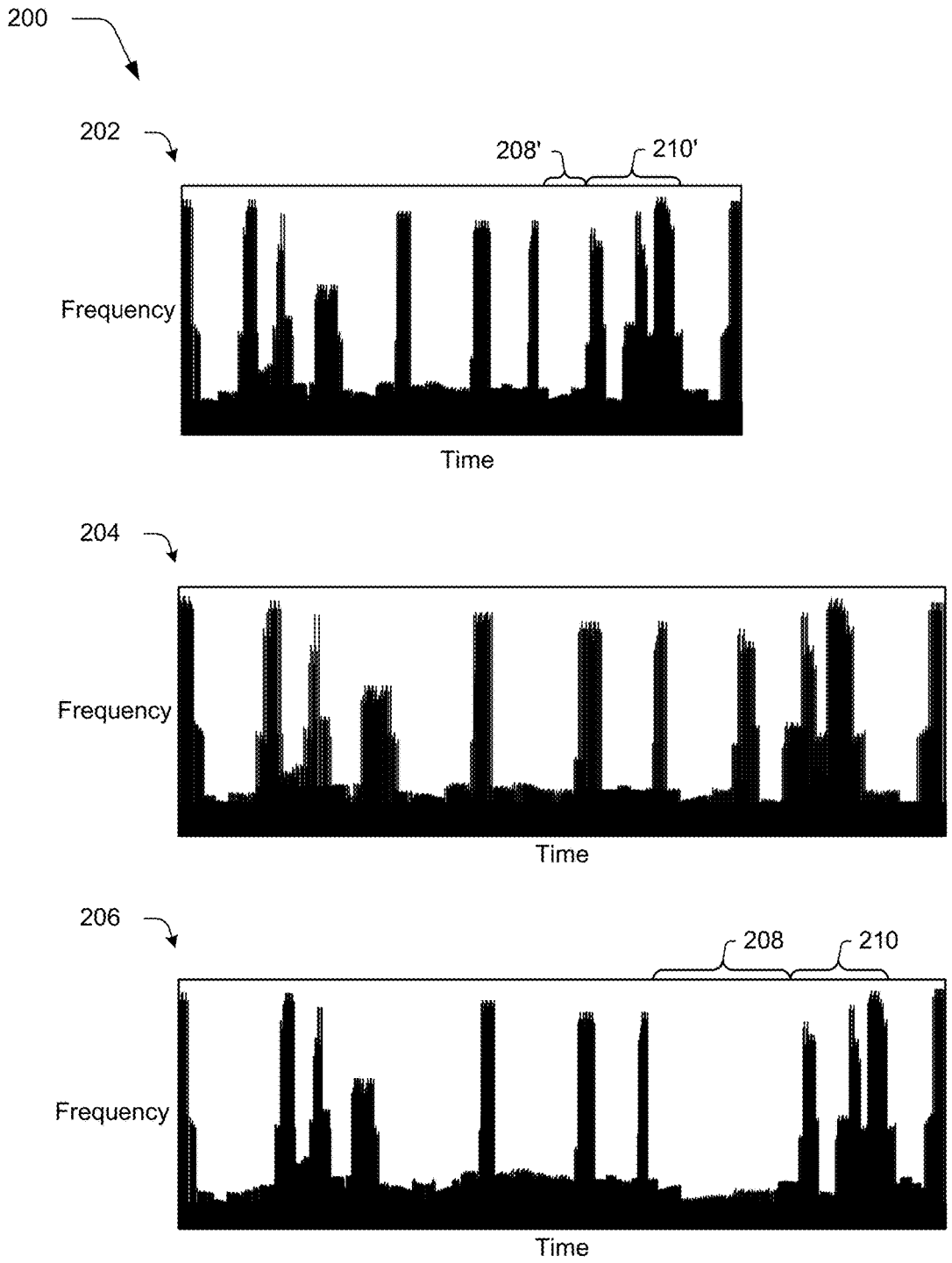
FIG. 2 depicts an example implementation showing rate modification of sound data by a rate modification module of FIG. 1.

FIG. 2 depicts an example implementation 200 showing rate modification of sound data 108 by the rate modification module 114. A representation 202 is shown of the sound data 108 in a time/frequency domain, although other examples are also contemplated. The representation 202 illustrates spectral characteristics of speech and other sound over an amount of time.

As previously described, a rate of output of the sound data 108 may be modified for a variety of reasons. In a conventional technique, the rate is modified such that the entirety of the sound data is stretched or compressed by the same amount. An example of this is shown by representation 204 in which a rate at which the sound data 108 is output is slowed down such that the sound data 108 takes a longer amount of time to output. However, as also previously described this caused a change in both time and pitch and thus could sound unnatural. This is illustrated through stretching of the spectral characteristics in the representation 204 in comparison with the representation 202 of the unmodified sound data.

The rate modification module 114, however, may employ sound rate rules that reflect a natural language model such that the rate of the sound data 108 may be modified to sound natural. The sound rate rules, for instance, may be used to calculate different rates that different portions of the sound data are to be modified. These rates may be based on characteristics of the sound data 108. As shown in the representation 206, for instance, a pause 208 between speech components that corresponds to a pause 208' in representation 202 may be modified at a rate that is greater than a modification made to a speech component 210 in representation 206 that corresponds to a speech component 210' in representation 202.

In this way, the rate modified sound data 116 that corresponds to representation 206 may sound natural to a user 122. Further, this modification may be performed on the sound data 108 itself, and thus may be performed without using reference sound data for alignment of features. Although one example of rate modification was described above, the sound rate modification rules may be utilized to calculate a variety of different rates based on a variety of different sound characteristics, additional examples of which are described as follows and shown in the corresponding figure.

Figure 3:
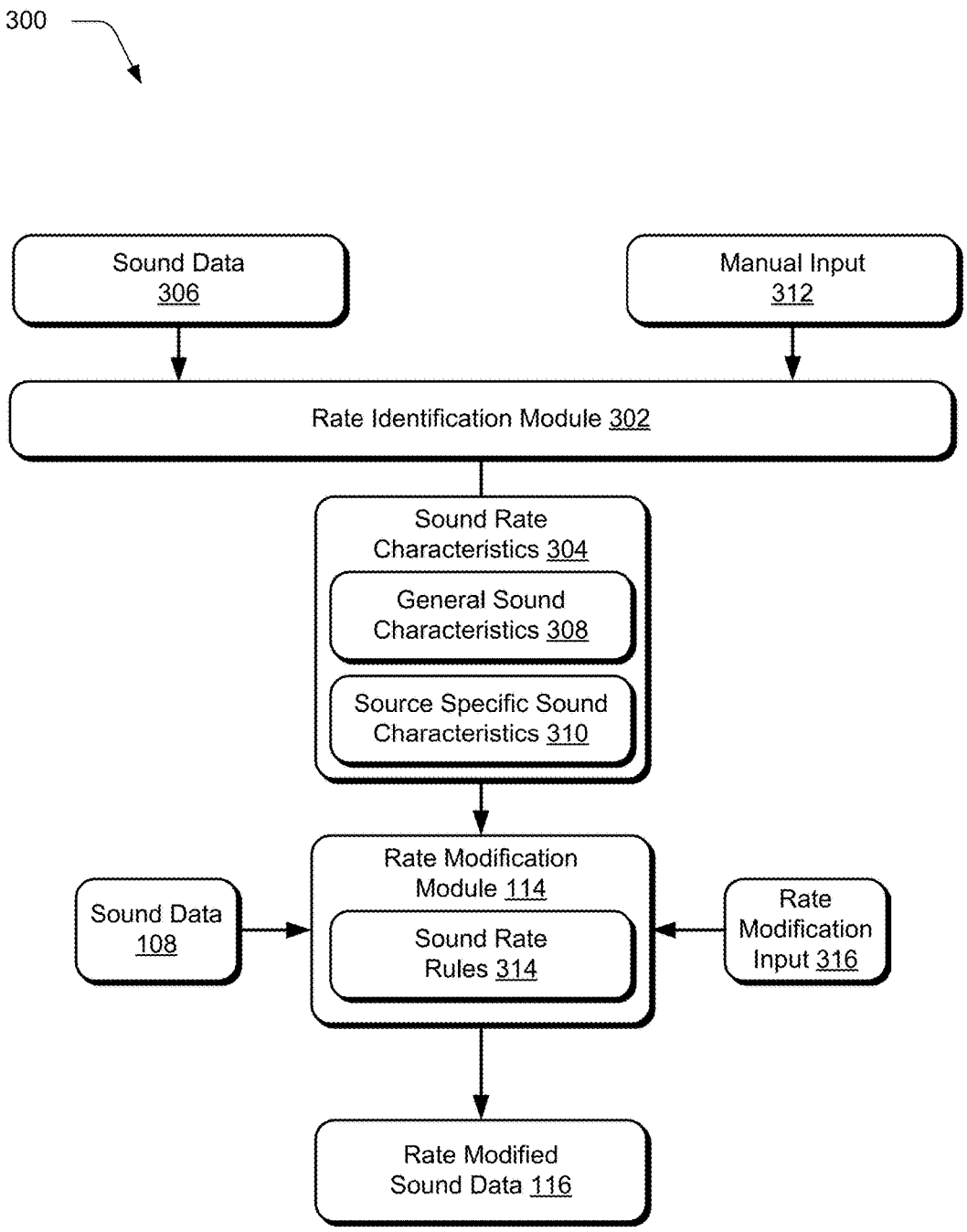
FIG. 3 depicts a system in an example implementation in which sound characteristics are identified and leveraged to generate sound rate rules that reflect a natural sound model.

FIG. 3 depicts a system 300 in an example implementation in which sound characteristics are identified and leveraged to generate sound rate rules that reflect a natural sound model. A rate identification module 302 is illustrated that is a representation of functionality to identify sound rate characteristics 304 that are indicative of natural sounds. Although speech is described in examples, it should be noted that this is not limited to spoken words and thus may also include other sounds, such as musical instruments, animals sounds, environmental sounds (e.g., rain, traffic), and even generated sounds such as sounds generated by a video game or other source.

The rate identification module 302, for instance, may be employed to process a corpus of sound data 306 to learn sound rate characteristics 304 of the sound data 306. This may be performed generally for a language or other sounds to generate general sound characteristics 308 as well as for source specific sound characteristics 310, such as for a particular speaker or other source. This may be performed in a variety of ways, such as through use of a hidden Markov model (HMM) or other machine learning technique.

A variety of different sound rate characteristics 304 may be learned automatically and without user intervention on the part of the rate identification module 302. For example, the sound rate characteristics 304 may describe appropriate pause lengths, such as where pauses can be added or removed. The sound rate characteristics 304 may also describe relative amounts that units of speech may be modified, such as for particular syllables, phrases, words, sentences, phones, and other sounds such as transient sounds that may be uttered by a user or other source.

The sound rate characteristics 304 may also describe a plurality of different amounts for the same units of speech. For example, a rate for a vowel sound "a" when used in a word "awful" may be different than when used in a word "Dad." Accordingly, a context in which the sound is encountered may be different and therefore this difference may be defined by the sound rate characteristics 304.

Manual inputs 312 may also be provided to the rate identification module 302 to generate the sound rate characteristics 304. The rate identification module 302, for instance, may output a user interface via which a user may define sound rate characteristics 304 for pauses and other units of speech such as for particular syllables, phrases, words, sentences, phones, and other sounds such as transient sounds (e.g., an utterance of "t") as previously described.

The rate modification module 114 may then utilize sound rate rules 314 that are generated (e.g., by the rate identification module 302 and/or the rate modification module 114 itself) from the sound rate characteristics 304 to modify sound data 108. The sound rate rules 314 may also be generated manually by a user through interaction with a user interface. Thus, the sound rate rules 314 may be learned automatically without user intervention and/or based at least in part on one or more user inputs. The sound rate rules 314 may then be employed to modify a rate at which sound data 108 is output.

A user 122, for instance, may select sound data 108 that is to be modified by the rate modification module 114. A rate modification input 316 may be received that indicates an amount that a rate an output of the sound data 108 is to be modified. The user, for instance, may interact with a user interface 118 to specify an amount of time the sound data 118 is to be output (e.g., ten minutes) or an amount by which the output of the sound is to be modified (e.g., eighty percent, slow down slightly, and so on). The rate modification input 316 may also be automatically generated, such as to conform sound data 108 to be output in a default amount of time.

The rate modification module 114 may then employ the sound rate rules 314 to calculate different rates at which different portions of the sound data are to be modified. The sound rate rules 314, for instance, may be applied for particular syllables, phrases, words, sentences, phones, and other sounds such as transient sounds that are identified in the sound data 108. Thus, the rate modification input 316 and the sound rate rules 314 may be used to arrive at a rate for particular portions of the sound data 108 that may be different than for other parts of the sound data 108.

The sound rate rules 314, for instance, may specify a cost for use as part of an optimization function for respective sound rate characteristics 304, weights for particular characteristics, threshold values that may not be exceeded, and so forth. Additionally, the sound rate rules 314 may be arranged in a hierarchy (e.g., as specified by a user, default, and so on) such that modifications are made in a particular order, such as to modify pause lengths and then speech components once a pause length threshold amount is reached.

Instances are also contemplated in which the rate of output of the sound data 108 is generally unchanged, overall. In such instances, the sound rate rules 314 may still be applied to modify rates within the sound data 108, such as for particular syllables, and so forth. This may be used to support a variety of different functionalities, such as to play back a user's own voice that is corrected to comply with the natural sound model, such as to learn a language. Further discussion of this example may be found in relation to FIG. 5.

The rate modification module 114 may then output rate modified sound data 116, which may be output via a sound output device 124, displayed in a user interface 118 on a display device 120, stored in memory of the computing device 102, and so on. In this way, the rate modification module 114 may employ techniques that are usable to modify a rate in output of sound data. Yet, these techniques may still promote a naturalness of the sound data, further discussion of which may be found in relation to the following section.

Example Procedures

The following discussion describes rate modification techniques that may be implemented that utilize the previously described systems and devices. Aspects of each of the procedures may be implemented in hardware, firmware, or software, or a combination thereof. The procedures are shown as a set of blocks that specify operations performed by one or more devices and are not necessarily limited to the orders shown for performing the operations by the respective blocks. In portions of the following discussion, reference will be made to FIGS. 1-3.

Figure 4:
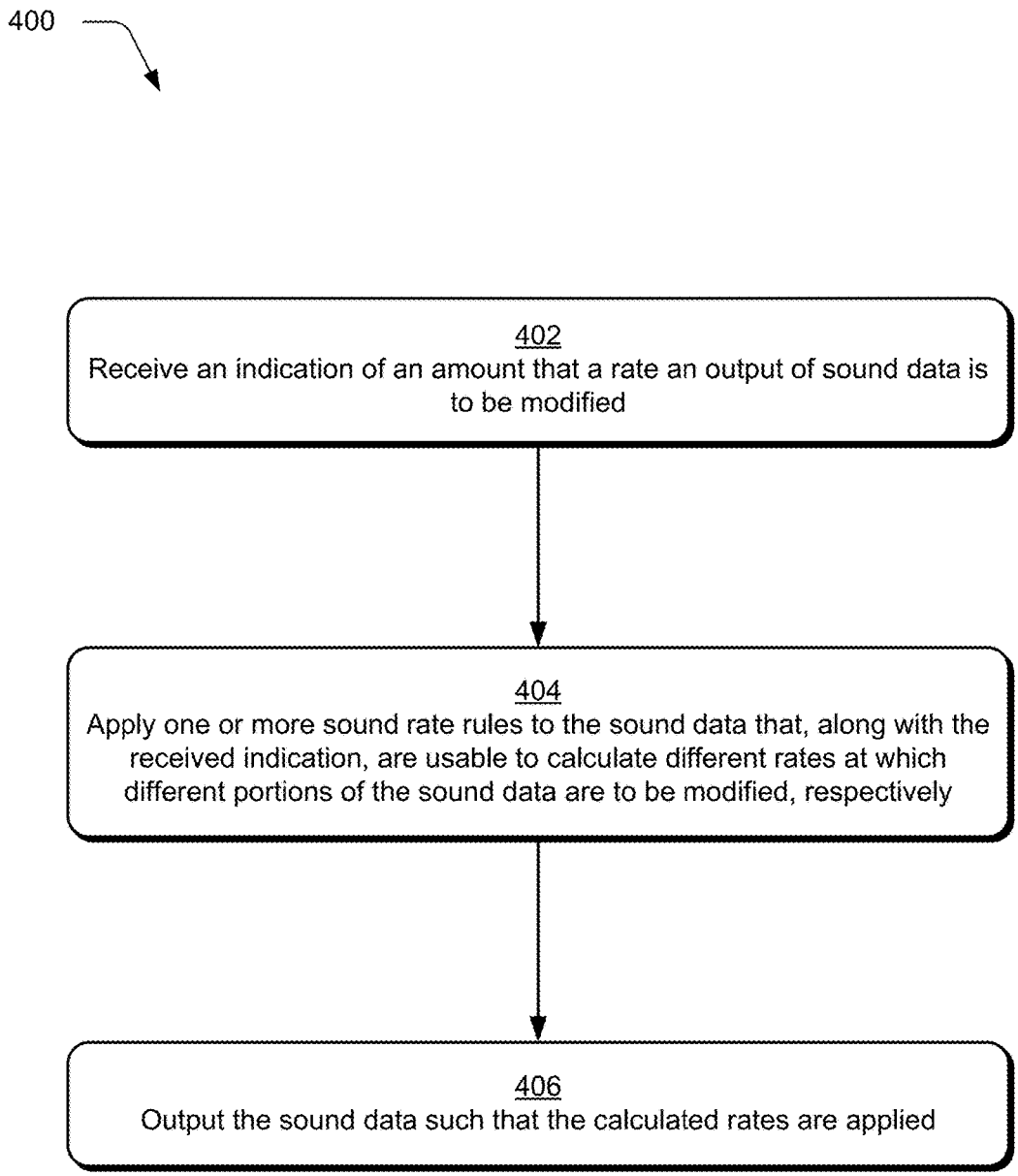
FIG. 4 is a flow diagram depicting a procedure in an example implementation in which a modification is made to a rate at which sound data is to be output using sound rate rules.

FIG. 4 depicts a procedure 400 in an example implementation in which a modification is made to a rate at which sound data is to be output using sound rate rules. An indication is received of an amount that a rate of an output of sound data is to be modified (block 402). The indication, for instance, may be received manually from a user via interaction with a user interface, automatically generated, and so on. The indication may also describe the amount in a variety of ways, such as an amount to be changed, an overall length to which sound data is to be conformed, and so on.

One or more sound rate rules are applied to the sound data that, along with the received indication, are usable to calculate different rates at which different portions of the sound data are to be modified, respectively (block 404). The sound rates rules and the indication, for instance, may be utilized to calculate different rates for different portions of the sound data depending on the sound characteristics for that portion, such as for a pause, syllable, phrase, pause, word, sentence, transient sound, or phone. The sound data is output such that the calculated rates are applied (block 406). Although a modification of an overall rate was described in this example, the sound data may also be modified such that an overall rate is maintained, generally, but different portions of the sound data are modified, such as to conform to a natural sound model, an example of which is described in relation to the following figure.

Figure 5:
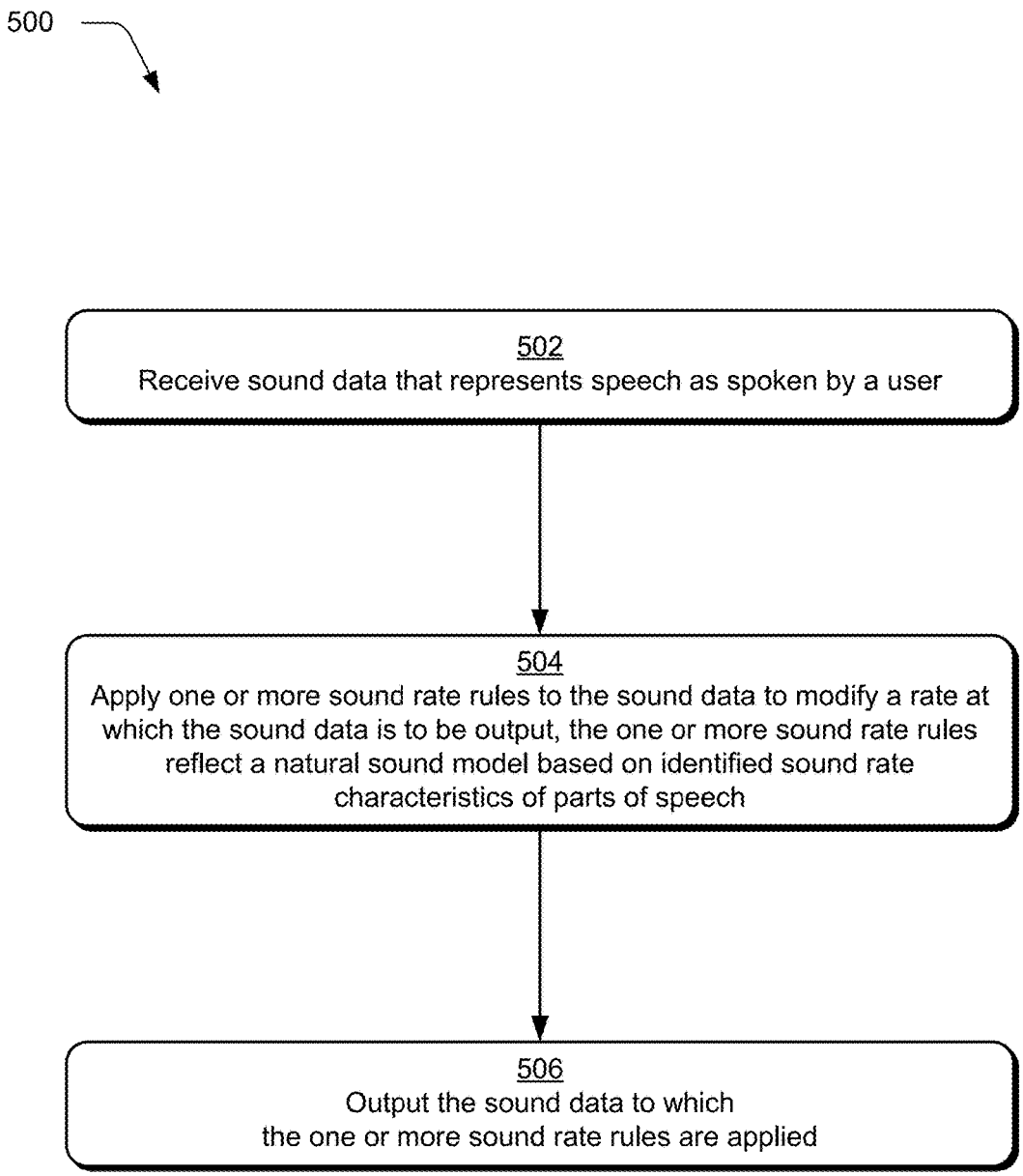
FIG. 5 is a flow diagram depicting a procedure in an example implementation in which sound rate rules are applied to conform sound data to a natural sound model.

FIG. 5 depicts a procedure 500 in an example implementation in which sound rate rules are applied to conform sound data to a natural sound model. Sound data is received that represents speech as spoken by a user (block 502). A user, for instance, may attempt to learn a new language and therefore speak a phrase in that language.

One or more sound rate rules are applied to the sound data to modify a rate at which the sound data is to be output, the one or more sound rate rules reflecting a natural sound model based on identified sound rate characteristics of parts of speech (block 504). Continuing with the previous example, the sound rate rules may reflect the natural sound model for the new language the user is attempting to learn. Accordingly, different portions of the sound data may be modified at different rates such that the sound data conforms to correct usage in that new language. The sound data may then be output to which the one or more sound rate rules are applied (block 506) and thus the user may hear a correct version of their phrase. A variety of other examples are also contemplated as previously described.

Example System and Device

Figure 6:
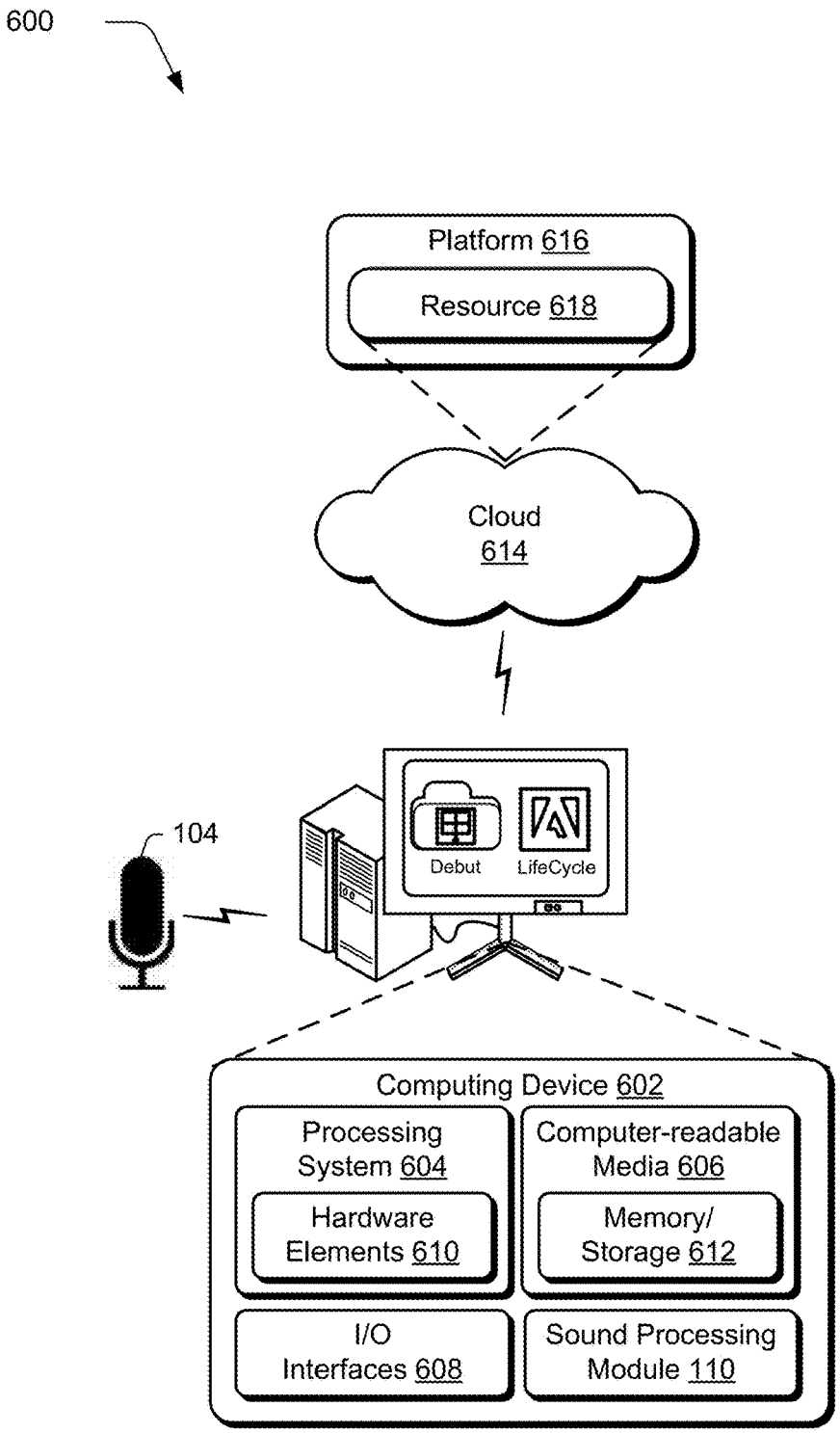
FIG. 6 illustrates an example system including various components of an example device that can be implemented as any type of computing device as described and/or utilize with reference to FIGS. 1-5 to implement embodiments of the techniques described herein.

FIG. 6 illustrates an example system generally at 600 that includes an example computing device 602 that is representative of one or more computing systems and/or devices that may implement the various techniques described herein. This is illustrated through inclusion of the sound processing module 110, which may be configured to process image data, such as sound data captured by the sound capture device 104. The computing device 602 may be, for example, a server of a service provider, a device associated with a client (e.g., a client device), an on-chip system, and/or any other suitable computing device or computing system.

The example computing device 602 as illustrated includes a processing system 604, one or more computer-readable media 606, and one or more I/O interface 608 that are communicatively coupled, one to another. Although not shown, the computing device 602 may further include a system bus or other data and command transfer system that couples the various components, one to another. A system bus can include any one or combination of different bus structures, such as a memory bus or memory controller, a peripheral bus, a universal serial bus, and/or a processor or local bus that utilizes any of a variety of bus architectures. A variety of other examples are also contemplated, such as control and data lines.

The processing system 604 is representative of functionality to perform one or more operations using hardware. Accordingly, the processing system 604 is illustrated as including hardware element 610 that may be configured as processors, functional blocks, and so forth. This may include implementation in hardware as an application specific integrated circuit or other logic device formed using one or more semiconductors. The hardware elements 610 are not limited by the materials from which they are formed or the processing mechanisms employed therein. For example, processors may be comprised of semiconductor(s) and/or transistors (e.g., electronic integrated circuits (ICs)). In such a context, processor-executable instructions may be electronically-executable instructions.

The computer-readable storage media 606 is illustrated as including memory/storage 612. The memory/storage 612 represents memory/storage capacity associated with one or more computer-readable media. The memory/storage component 612 may include volatile media (such as random access memory (RAM)) and/or nonvolatile media (such as read only memory (ROM), Flash memory, optical disks, magnetic disks, and so forth). The memory/storage component 612 may include fixed media (e.g., RAM, ROM, a fixed hard drive, and so on) as well as removable media (e.g., Flash memory, a removable hard drive, an optical disc, and so forth). The computer-readable media 606 may be configured in a variety of other ways as further described below.

Input/output interface(s) 608 are representative of functionality to allow a user to enter commands and information to computing device 602, and also allow information to be presented to the user and/or other components or devices using various input/output devices. Examples of input devices include a keyboard, a cursor control device (e.g., a mouse), a microphone, a scanner, touch functionality (e.g., capacitive or other sensors that are configured to detect physical touch), a camera (e.g., which may employ visible or non-visible wavelengths such as infrared frequencies to recognize movement as gestures that do not involve touch), and so forth. Examples of output devices include a display device (e.g., a monitor or projector), speakers, a printer, a network card, tactile-response device, and so forth. Thus, the computing device 602 may be configured in a variety of ways as further described below to support user interaction.

Various techniques may be described herein in the general context of software, hardware elements, or program modules. Generally, such modules include routines, programs, objects, elements, components, data structures, and so forth that perform particular tasks or implement particular abstract data types. The terms "module," "functionality," and "component" as used herein generally represent software, firmware, hardware, or a combination thereof. The features of the techniques described herein are platform-independent, meaning that the techniques may be implemented on a variety of commercial computing platforms having a variety of processors.

An implementation of the described modules and techniques may be stored on or transmitted across some form of computer-readable media. The computer-readable media may include a variety of media that may be accessed by the computing device 602. By way of example, and not limitation, computer-readable media may include "computer-readable storage media" and "computer-readable signal media."

"Computer-readable storage media" may refer to media and/or devices that enable persistent and/or non-transitory storage of information in contrast to mere signal transmission, carrier waves, or signals per se. Thus, computer-readable storage media refers to non-signal bearing media. The computer-readable storage media includes hardware such as volatile and non-volatile, removable and non-removable media and/or storage devices implemented in a method or technology suitable for storage of information such as computer readable instructions, data structures, program modules, logic elements/circuits, or other data. Examples of computer-readable storage media may include, but are not limited to, RAM, ROM, EEPROM, flash memory or other memory technology, CD-ROM, digital versatile disks (DVD) or other optical storage, hard disks, magnetic cassettes, magnetic tape, magnetic disk storage or other magnetic storage devices, or other storage device, tangible media, or article of manufacture suitable to store the desired information and which may be accessed by a computer.

"Computer-readable signal media" may refer to a signal-bearing medium that is configured to transmit instructions to the hardware of the computing device 602, such as via a network. Signal media typically may embody computer readable instructions, data structures, program modules, or other data in a modulated data signal, such as carrier waves, data signals, or other transport mechanism. Signal media also include any information delivery media. The term "modulated data signal" means a signal that has one or more of its characteristics set or changed in such a manner as to encode information in the signal. By way of example, and not limitation, communication media include wired media such as a wired network or direct-wired connection, and wireless media such as acoustic, RF, infrared, and other wireless media.

As previously described, hardware elements 610 and computer-readable media 606 are representative of modules, programmable device logic and/or fixed device logic implemented in a hardware form that may be employed in some embodiments to implement at least some aspects of the techniques described herein, such as to perform one or more instructions. Hardware may include components of an integrated circuit or on-chip system, an application-specific integrated circuit (ASIC), a field-programmable gate array (FPGA), a complex programmable logic device (CPLD), and other implementations in silicon or other hardware. In this context, hardware may operate as a processing device that performs program tasks defined by instructions and/or logic embodied by the hardware as well as a hardware utilized to store instructions for execution, e.g., the computer-readable storage media described previously.

Combinations of the foregoing may also be employed to implement various techniques described herein. Accordingly, software, hardware, or executable modules may be implemented as one or more instructions and/or logic embodied on some form of computer-readable storage media and/or by one or more hardware elements 610. The computing device 602 may be configured to implement particular instructions and/or functions corresponding to the software and/or hardware modules. Accordingly, implementation of a module that is executable by the computing device 602 as software may be achieved at least partially in hardware, e.g., through use of computer-readable storage media and/or hardware elements 610 of the processing system 604. The instructions and/or functions may be executable/operable by one or more articles of manufacture (for example, one or more computing devices 602 and/or processing systems 604) to implement techniques, modules, and examples described herein.

The techniques described herein may be supported by various configurations of the computing device 602 and are not limited to the specific examples of the techniques described herein. This functionality may also be implemented all or in part through use of a distributed system, such as over a "cloud" 614 via a platform 616 as described below.

The cloud 614 includes and/or is representative of a platform 616 for resources 618. The platform 616 abstracts underlying functionality of hardware (e.g., servers) and software resources of the cloud 614. The resources 618 may include applications and/or data that can be utilized while computer processing is executed on servers that are remote from the computing device 602. Resources 618 can also include services provided over the Internet and/or through a subscriber network, such as a cellular or Wi-Fi network.

The platform 616 may abstract resources and functions to connect the computing device 602 with other computing devices. The platform 616 may also serve to abstract scaling of resources to provide a corresponding level of scale to encountered demand for the resources 618 that are implemented via the platform 616. Accordingly, in an interconnected device embodiment, implementation of functionality described herein may be distributed throughout the system 600. For example, the functionality may be implemented in part on the computing device 602 as well as via the platform 616 that abstracts the functionality of the cloud 614.

CONCLUSION

Although the invention has been described in language specific to structural features and/or methodological acts, it is to be understood that the invention defined in the appended claims is not necessarily limited to the specific features or acts described. Rather, the specific features and acts are disclosed as example forms of implementing the claimed invention.

What is claimed is:

1. A method implemented by at least one computing device, the method comprising:

receiving, as a user input, by the at least one computing device, an indication of an amount of time in which sound data is to be output, the sound data including a waveform representation and a plurality of portions, the indicated amount of time being different from an unmodified amount of time for playback of the sound data;

identifying, by the at least one computing device, at least one active portion and at least one inactive portion of the plurality of portions of the sound data based on spectral characteristics of the sound data, the at least one active portion containing multiple different units of speech, the at least one inactive portion corresponding to pauses in speech;

modifying, by the at least one computing device, the sound data to be output in the indicated amount of time using a set of sound rate rules generated to capture sound rate characteristics of units of speech in a natural language model by:

calculating different relative rates at which the multiple different units of speech are to be output, respectively, based on the set of sound rate rules and the indicated amount of time, applying a first calculated rate to a first unit of speech in the active portion to cause the first unit of speech to be output at the first calculated rate, and applying a second different calculated rate to a second unit of speech in the active portion to cause the second unit of speech to be output at the second different calculated rate; and outputting, by the at least one computing device, the sound data as modified by the first calculated rate and the second different calculated rate in the indicated amount of time.

2. A method as described in claim 1, further comprising receiving, by the at least one computing device, at least one sound rate rule of the set of sound rate rules specified manually by a user.

3. A method as described in claim 1, further comprising learning, by the at least one computing device, at least one sound rate rule of the set of sound rate rules automatically and without user intervention through processing of a corpus of sound data.

4. A method as described in claim 1, wherein the indication specifies that the sound data is to be output in a longer amount of time than the unmodified amount of time for playback of the sound data.

5. A method as described in claim 1, wherein the at least one active portion includes a plurality of active portions, and the set of sound rate rules is usable to calculate a rate for each of the plurality of active portions.

6. A method as described in claim 1, wherein at least one of the set of sound rate rules specifies a value for a corresponding unit of speech usable to calculate the rate.

7. A method as described in claim 6, wherein the value is a cost, weight, or threshold value.

8. A method as described in claim 6, wherein the unit of speech is a syllable, phrase, pause, word, sentence, transient sound, or phone.

9. A method as described in claim 6, wherein the set of sound rate rules specify a plurality of values for a single said corresponding unit of speech, at least one said value of which is specified for a context in which the single said corresponding unit of speech is encountered in the sound data.

10. A method as described in claim 1, wherein the set of sound rate rules are arranged in a hierarchy such that a first said rule that corresponds to a first active portion is to be applied before a second said rule that corresponds to a second active portion.

11. A system comprising:

at least one module implemented at least partially in hardware and configured to:

receive input specifying a time period over which sound data is to be output, the sound data including a plurality of portions;

identify at least one active portion and at least one inactive portion of the plurality of portions of the sound data based on spectral characteristics of the sound data, the at least one active portion containing multiple different units of speech, the at least one inactive portion corresponding to pauses in speech;

modify the sound data using a set of sound rate rules that reflect a natural language model rule to the sound data by:

calculating different relative rates at which the different units of speech are to be output, respectively, based on the set of sound rate rules;

applying a first calculated rate to a first unit of speech in the active portion to cause the first unit of speech to be output at the first calculated rate; and applying a second different calculated rate to a second unit of speech in the active portion to cause the second unit of speech to be output at the second different calculated rate; and output the sound data as modified by the first calculated rate and the second different calculated rate over the specified time period.

12. A system as described in claim 11, wherein the at least one module if configured to receive at least one sound rate rule of the set of sound rate rules specified manually by a user.

13. A system as described in claim 11, wherein the indication specifies that the rate of the output of the sound data is to be generally unchanged while the sound data is being output.

14. A system as described in claim 11, wherein the at least one active portion includes a plurality of active portions, and the set of sound rate rules is usable to calculate a rate for each of the plurality of active portions.

15. A system as described in claim 11, wherein the set of sound rate rules are arranged in a hierarchy such that a first said rule that corresponds to a first active portion is to be applied before a second said rule that corresponds to a second active portion.

16. At least one computer-readable storage medium having instructions stored thereon that, responsive to execution on a computing device, causes the computing device to perform operations comprising:

receiving input specifying a time period over which sound data is to be output, the sound data including a plurality of portions;

identifying at least one active portion and at least one inactive portion of the plurality of portions of the sound data based on spectral characteristics of the sound data, the at least one active portion containing multiple different units of speech, the at least one inactive portion corresponding to pauses in speech;

modifying the sound data using a set of sound rate rules that reflect a natural language model rule to the sound data by:

calculating different relative rates at which the different units of speech are to be output, respectively, based on the set of sound rate rules to enable the sound data to be output within the specified period of time;

applying a first calculated rate to a first unit of speech in the active portion to cause the first unit of speech to be output at the first calculated rate; and applying a second different calculated rate to a second unit of speech in the active portion to cause the second unit of speech to be output at the second different calculated rate; and outputting the sound data as modified by the first calculated rate and the second different calculated rate over the specified time period.

17. At least one computer-readable storage medium as described in claim 16, wherein the input specifying the time period is specified manually by a user.

18. At least one computer-readable storage medium as described in claim 16, wherein the input specifying the time period specifies that the rate of the output of the sound data is to be generally unchanged while the sound data is being output.

19. At least one computer-readable storage medium as described in claim 16, wherein the at least one active portion includes a plurality of active portions, and the set of sound rate rules is usable to calculate a rate for each of the plurality of active portions.

20. At least one computer-readable storage medium as described in claim 16, wherein the set of sound rate rules are arranged in a hierarchy such that a first said rule that corresponds to a first active portion is to be applied before a second said rule that corresponds to a second active portion.

* * * * *